United States Patent [19]

Adickes, Jr. et al.

[11] 4,286,407

[45] Sep. 1, 1981

[54] DOLL FOR CONTAINING FILAMENT PRODUCING FLUID

[75] Inventors: Cecil F. Adickes, Jr., Playa del Rey, Calif.; David R. Berko, Flushing, N.Y.

[73] Assignee: Mego Corp., New York, N.Y.

[21] Appl. No.: 131,119

[22] Filed: Mar. 17, 1980

[51] Int. Cl.[3] ..... A63H 3/00

[52] U.S. Cl. ..... 46/163; 46/44; 222/78; 222/215

[58] Field of Search ..... 46/161, 163, 44, 92; 222/78, 215

[56] References Cited

U.S. PATENT DOCUMENTS

| | | | |
|---|---|---|---|
| 95,489 | 10/1869 | Kintzback | 46/163 |
| 1,767,911 | 6/1930 | Berko et al. | 46/116 X |
| 2,506,328 | 5/1950 | Alger | 46/173 X |
| 2,634,545 | 4/1953 | Gertz | 46/92 X |
| 2,644,272 | 7/1953 | Cohn | 46/161 X |
| 3,353,823 | 11/1967 | Sobel | 46/44 X |
| 3,388,835 | 6/1968 | Naughten | 222/78 |
| 3,942,284 | 3/1976 | Kublan | 46/161 |
| 3,956,850 | 5/1976 | Seidenberg | 46/163 X |
| 4,217,725 | 8/1980 | Sapkus et al. | 46/44 |

*Primary Examiner*—F. Barry Shay
*Attorney, Agent, or Firm*—Bertram Frank

[57] ABSTRACT

An action figure doll capable of simulating the web making feat of the Spider Man Super-Hero is disclosed. The doll has a modified arm containing a fluid which produces the individual filaments of a spider like web when the arm is set and activated by the application of pressure to a section of the modified arm. The modified arm includes means for minimizing exposure of the filament-producing fluid.

9 Claims, 5 Drawing Figures

DOLL FOR CONTAINING FILAMENT PRODUCING FLUID

BACKGROUND OF THE INVENTION

The present invention is in dolls and more specifically in the field of adjustable position action dolls.

Recent trends in entertainment have seen the revival of comic strip heroes such as Wonder Woman, Superman and the Incredible Hulk to name only a few. An aspect of this revival of the Superheroes appears in the form of children's Super-Hero dolls with or without accessories to enable children to play with the dolls in an action type setting or accomplish a task by portrayal of a special ability or implementation of a characteristic of the particular Super-Hero.

Recent developments in the art have resulted in significantly improved and more versatile dolls. U.S. Pat. No. 3,942,284 discloses doll figures equipped with movable and positionable hands, legs, knees, ankles and torsos.

SUMMARY OF THE INVENTION

The present invention is an adjustable position action dolls and provides a convenient means by which a child may portray an action feat of the Super-Hero, Spider Man. More specifically, the present invention provides a means whereby the user of the doll may simulate Spider Man's ability to form a web-like configuration by systematically providing the individual elements thereof by activating, by pressure, a modified arm of the doll figure. The modified arm contains a fluid substance characterized by its ability to maintain its integrity as a filament form for a filament of considerable length.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated a preferred embodiment of the invention.

DESCRIPTION OF THE PREFERRED EMBODIMENT

Figure 1:
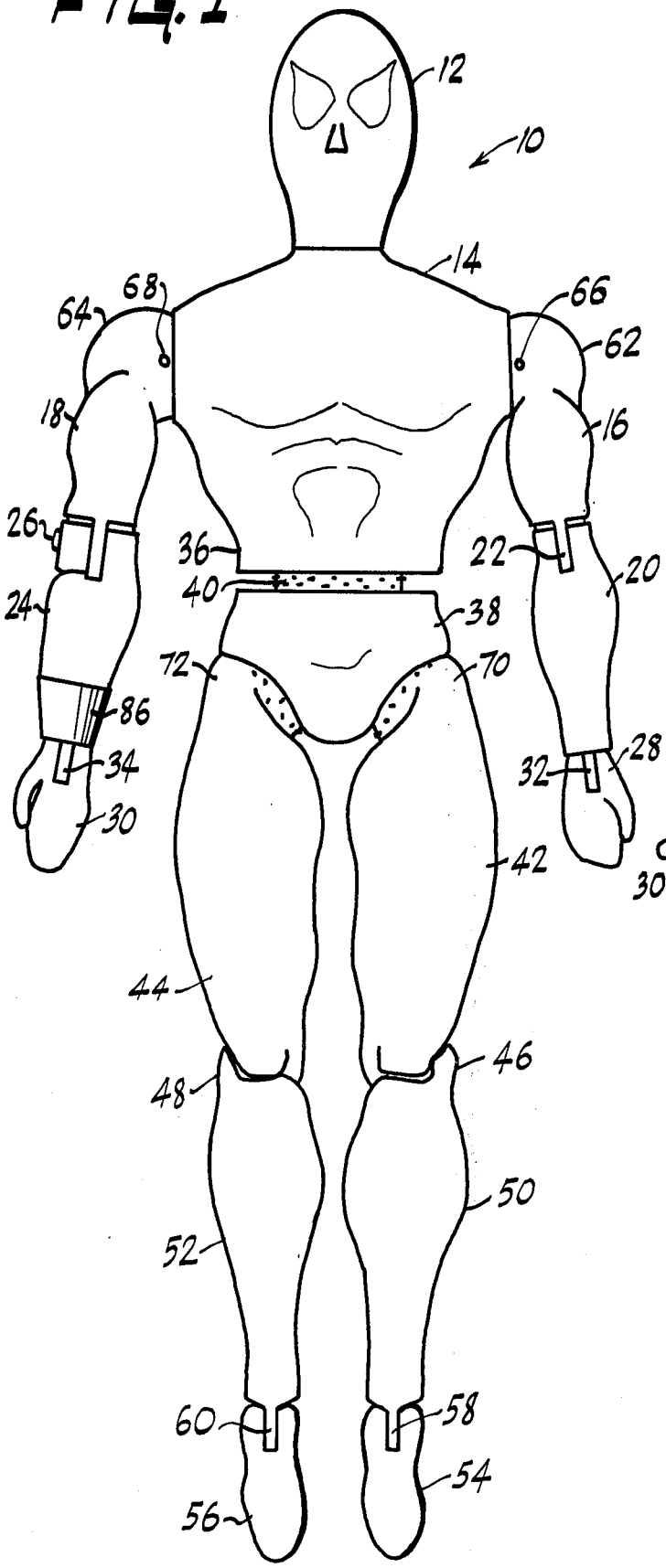
FIG. 1 generally depicts a front elevation view of a preferred type of construction for the doll.

Referring to FIG. 1, depicted therein is a disrobed Spider Man doll 10. The action figure includes a head 12, rotatably mounted on the upper torso 14 by a plug in socket arrangement (not shown). Upper arms 16 and 18 are affixed to the upper torso 14 in accordance with the construction and arrangement as disclosed in U.S. Pat. No. 3,942,284, the disclosure of which is hereby incorporated by reference. Forearm 20 of upper arm 16 is movably attached to the latter by a pin in slot-groove arrangement 22 as also shown and described in the above referred to patent. Forearm 24 is moveably attached to upper arm 18 by a modified pin in slot-groove arrangement 26 which will be subsequently discussed in detail. Hands 28 and 30 are moveably attached to forearms 20 and 24 respectively similar to the arrangement 22 between upper arm 16 and forearm 20.

The base 36 of torso 14 is connected in a rotatable relationship with trunk 38, by a spherical universal joint 40 as disclosed in U.S. Pat. No. 3,942,284. Moveably attached to, and extending from trunk 38 are thigh sections 42 and 44. Thighs sections 42 and 44 are connected to lower leg sections 46 and 48 respectively by modified pin in slot-groove connections 50 and 52 respectively. Feet 54 and 56 are moveably attached to lower legs 50 and 52 by pin in slot-groove arrangements 58 and 60 respectively which are similar in construction to arrangement 22 between upper arm 16 and forearm 20.

Deltoid sections 62 and 64 of upper arms 16 and 18 respectively are transversed dorsally by pins 66 and 68 respectively. Connection devices (not shown) attach at one end to each of the pins within the interior portion of each deltoid section. The other end of the connection pins are attached to a resilient means (not shown) such as a rubber band, which extends downwardly within torso 14 through the hollow spherical universal joint 40 through trunk 38 to attach to hooks (not shown) in internally depressed sections (not shown) of the spherical joints 70 and 72 of the upper thigh regions 42 and 44 respectively. It will be noted that the resilient means is sized such that it is under tension when it extends from the connection on pin 66 to the hook on spherical joint 70. Likewise, a separate resilient means is placed under tension when it extends from the connection of pin 70 to the hook on spherical joint 72.

While it is preferred that the doll employed in the invention be an articulated doll, it will be understood that a completely articulated doll is not a necessity for the practice of the invention and that a conventional stationary doll may, with slight modifications hereinafter described, be employed in the present invention.

It will be recalled that the Spider Man hero is not only garbed in a particular outfit but is characterized by the ability to spin a spider-like web. This ability is associated with an arm of the Spider Man character.

Figure 2:
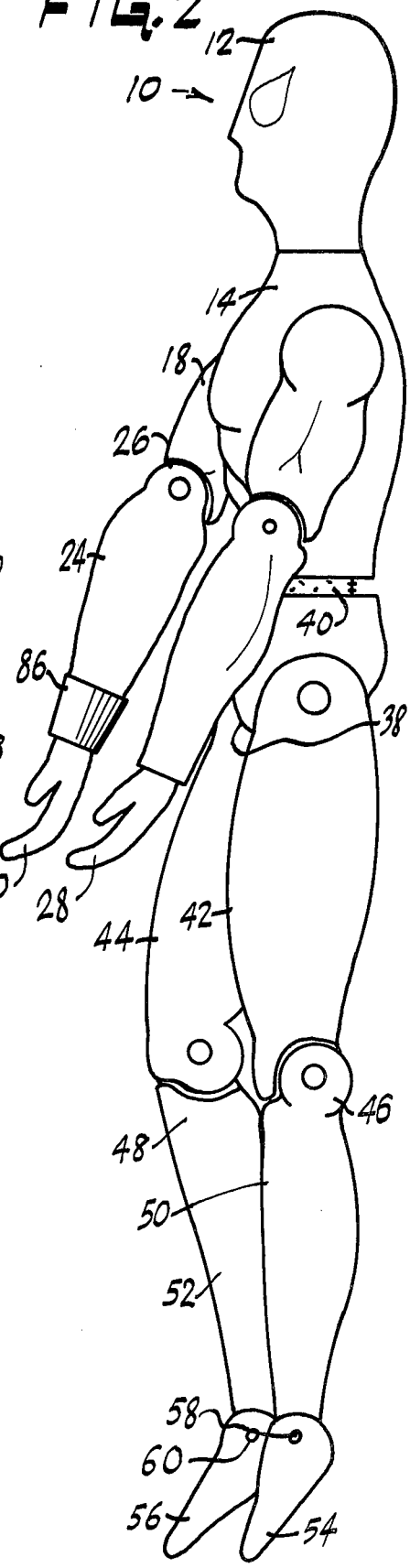
FIG. 2 illustrates a left side elevation view of the doll depicted in FIG. 1.
Figure 3:
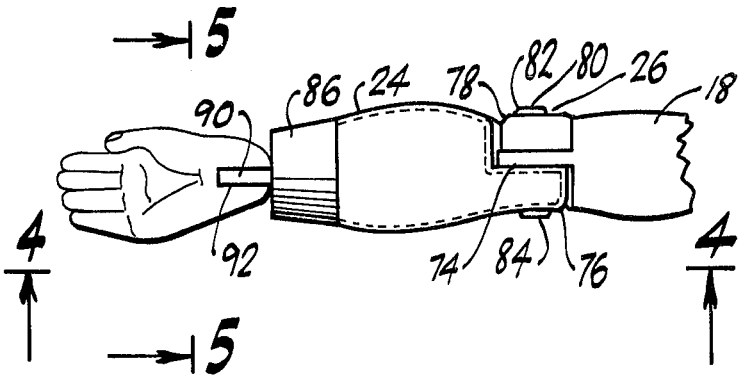
FIG. 3 shows a detail of an especially adapted arm of the doll of FIG. 1.
Figure 4:
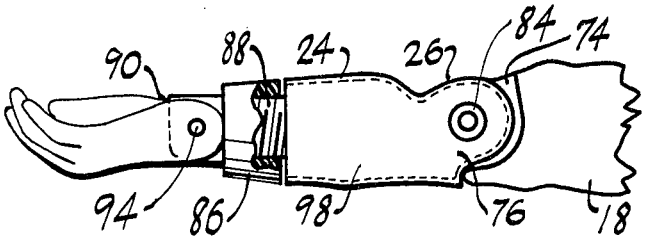
FIG. 4 is a view of FIG. 3 along 4—4 but with the arm disassembled at the wrist.
Figure 5:
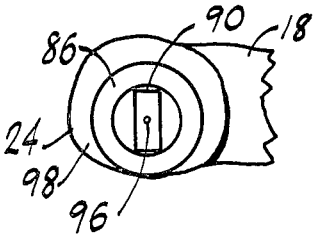
FIG. 5 is a view of FIG. 3 along 5—5 but with the hand removed.

FIGS. 1 and 2 generally depict the unclothed action figure with a modified right forearm. FIGS. 3, 4 and 5 show various views and details of an adapted arm from a portion of the upper arm (bicep area) below the deltoid extending to the hand 30.

As shown in FIGS. 3 and 4, the upper arm 18 is attached to forearm 24 by a pin in slot groove arrangement 26. This attachment assembly comprises a projection 74 emanating from upper arm 18 sandwiched between a rearward section 76 of forearm 24 and a fill-in section 78. Projection 74, sections 76 and 78 are adapted to receive and maintain a pin 80 having enlarged portions 82 and 84 and affixed by procedures well known to those skilled in the art. The cutaway shape of the rearward portion 76 of forearm 24 allows the assembly to pivot about pin 80 much as a forearm can pivot about an elbow. It will also be appreciated that filler section 78 may be formed as part of the upper arm 18. However, this is a manufacturing decision.

The forearm is constructed of an easily compressible and clear plastic such as EVA (ethyl vinyl acetate) and may be formed by a slow molding process. The wall thickness of the hollow plastic forearm should be chosen so as to be easily compressible by young children, yet be sufficiently durable to withstand repeated compressing and other manipulations. Additional considerations influencing the choice of materials for construction of forearm 24 will be subsequently discussed.

FIG. 4 shows a view of the forearm 18 disassembled at the wrist 86. The forward portion of forearm 24 is a threaded hollow section 88 of lesser diameter than the forearm 24. The wrist 86 is hollow but internally adapted to receive and mate with the threaded section 86. Wrist 86 may be constructed of Celcon or a like material.

Wrist section 86 is an important element of the present invention. Besides serving as a removable wrist section of the doll, it acts as a cap for hollow forearm 24 and further serves as a base from which projection 90 extends into slot 92 of hand 30. In service as a cap, wrist section 86 in conjunction with hand 30, minimizes the amount of air entering into forearm 24 thus alleviating any detrimental effect that prolonged exposure may have on the fluid contained therein, i.e. hardening, etc. Pin 94 traverses hand 30, slot 92 and projection 90 so as to allow rotation of hand 30 about pin 94.

Like wrist 86, projection 90 is a multipurpose element of the invention in that it serves not only as a projection to effect a connection between hand 30 and wrist 86, but it also serves, by means of aperture 96, to communicate with the interior portion 98 of forearm 24. Preferably, the aperture is circular in configuration and has a diameter of approximately 1/16 of an inch (approximately 1.5 mm). The aperture dimensions will significantly determine the thickness of the filament extending therefromand consequently influence the weight to length ratio of the filament.

Hollow portion 98 of forearm 24 is adapted to serve as a container for and to receive a fluid substance. The hollow portion 98 is filled by unscrewing the wrist 86 at connection 88 and introducing the fluid, preferably from a squeezeable tube, into the hollow portion 98 of the forearm 24. The hand 30 and wrist 86 are then screwed back in place. It will be understood that another consideration governing the selection of the forearm and wrist materials will be the interaction or lack of interaction between the fluid and those portions of the doll.

The fluid to be injected into hollow portion 98 of forearm 24 must have specific properties. Of primary importance is that the fluid be non-toxic and safe for use in children's toys. The fluid material must also be inert with respect to the forearm 24. Additionally, the fluid must have some degree of adhesiveness and still display satisfactory cohesive properties such that the material can form a thread-like (web-like) string for substantial distances without breaking from its own weight over the span. Furthermore, the material must have suitable flow properties for the particular application involved.

A web maker substance suitable for use and meeting the above requirements is a simple polymer composition. The best known approximate composition breakdown (by weight) is as follows:

| | |
|---|---|
| Polyox Coogulant | 3½% |
| PEG 200 | 10% |
| PEG 20,000 | 27½% |
| $H_2O$ (deionized) | 59% |

An alternate approximate composition breakdown by weight is as follows:

| | |
|---|---|
| Polyox Coogulant | 3% |
| PEG 20,000 | 20% |
| Propylene glyol | 5% |
| Sodium Citrate | 2% |
| $H_2O$ (de-mineralized) | App. 70% |
| Isopropanol | 1% |

Polyox Coogulant is a tradename for polyethylene oxide which is a water soluble thickener material. PEG is an acronym for polyethylene glycol. Numerical designations such as 200 and 20,000 refer to the molecular weight of the polymer thereby distinguishing products of various polymer chain lengths. The remaining constituents are well known to those of ordinary skill in the art. The above listed chemical constituents are available from Union Carbide Co. The product hereinafter referred to as "Web-Maker" is produced by blending the above-listed materials in a conventional manner.

The Spider Man figure may now be described in terms of the manner in which a child will play with doll. The first matter is to introduce the web-maker fluid into the hollow portion 98 of the forearm 24. As previously described, this merely requires unscrewing the wrist 86 at 88 and squeezing the web-maker tube so as to fill the hollow portion 98 of the forearm 24. The wrist 86 is then replaced. The doll is now ready for action.

A child playing with this toy will move the figure into various positions and place the doll in varying situations imitating story plots or other adventure type situations. To utilize the doll's web-making ability, the child need merely pivot hand 30 about pin 34 outward from the body exposing aperture 96. By placing the aperture in contact with a surface and gently squeezing forearm 24 and then slowly moving the action figure so the aperture 96 is contacted with a second surface, a filament of a web can be generated. Manipulation of the figure to bring aperture 96 in contact with a third surface while gently squeezing forearm 24 will produce another filament of a web. The process may be continued until the web is formed. Subsequent thereto, the hand 30 may again be rotated inwardly toward torso 14 to conceal aperture 96. Thus, it will be seen that by a few simple rotations and manipulations of the doll figure the web spinning ability of the Spider Man action hero may be duplicated.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

The embodiments of the invention in which an exclusive property or privilege is claimed are defined as follows:

1. In a doll having a plurality of limbs, the improvement comprising an adjustable limb having a hollow forearm section threaded for attachment, a wrist section adapted to connect with the threaded section, the wrist section having an aperture therethrough therein through which a filament-producing fluid from said hollow forearm section may pass upon activation of the hollow forearm section.

2. A doll as in claim 1 wherein the forearm section is constructed of EVA.

3. The doll as in claim 1 wherein the wrist section includes means to cover the aperture therein.

4. The doll of claim 2 wherein the aperture covering means is a hand of the limb.

5. The doll of claim 1 wherein the limb contains a filament-producing fluid.

6. A doll as in claim 5 wherein the fluid is a mixture of a thickening agent, polyethylene glycol and deionized water.

7. A doll as in claim 5 wherein the fluid is a mixture of polyethylene oxide, polyethylene glycol and deionized water.

8. A doll as in claim 5 wherein the fluid is a mixture of a thickening agent, polyethylene glycol, propylene glycol, sodium citrate, deionized water and isopropanol.

9. A doll as in claim 8 wherein the thickening agent is polyethylene oxide.

* * * * *